US005141593A

United States Patent [19]

Fowler

[11] Patent Number: 5,141,593

[45] Date of Patent: Aug. 25, 1992

[54] MANUALLY OPERABLE LABEL-TRANSFER APPARATUS

[76] Inventor: Robert E. Fowler, 517 Deerpath Ct., Deerfield, Ill. 60015

[21] Appl. No.: 663,250

[22] Filed: Mar. 1, 1991

[51] Int. Cl.[5] ..... B44C 1/16

[52] U.S. Cl. ..... 156/542; 156/579; 156/DIG. 2; 156/DIG. 33; 156/DIG. 42; 156/DIG. 48; 271/2

[58] Field of Search ..... 156/542, 584, 344, 442, 156/540, 541, 556, DIG. 2, DIG. 48, 579, DIG. 27, DIG. 33, DIG. 42; 271/2; 364/464.02, 478; 270/58

[56] References Cited

U.S. PATENT DOCUMENTS

| | | | |
|---|---|---|---|
| 2,276,296 | 3/1942 | Flood | 206/58 |
| 2,276,297 | 3/1942 | Flood | 242/55 |
| 2,331,019 | 10/1943 | Flood | 242/55.2 |
| 3,487,977 | 1/1970 | Andersson | 221/73 |
| 3,721,601 | 3/1973 | Pituch et al. | 156/541 X |
| 4,053,345 | 10/1977 | Hamisch, Jr. | 156/384 |
| 4,188,252 | 2/1980 | Brown | 156/542 X |
| 4,648,930 | 3/1987 | La Mers | 156/247 |
| 4,758,303 | 7/1988 | Shastko | 156/542 |

*Primary Examiner*—Michael W. Ball

*Assistant Examiner*—Mark A. Osele

*Attorney, Agent, or Firm*—Walter C. Ramm

[57] ABSTRACT

Manually operable label-transfer apparatus characterized by a transit path for a tractor-feedable backing strip which has labels or similar adhesive-backed pieces laminated thereon, and also providing a bin. The path has up-path first and down-path second stations, and the bin adjoins the first station. The apparatus has tractors at the second station, a pusher in the bin, and manual crank-drive means associated with the tractors and the pusher. The tractors engage the strip and, driven by the drive means, advance the strip down-path from the first station and over a delaminator with an edge and around a sharp turn. The strip, as drawn past the turn, is bent and experiences a direction reversal of between 160° and 180°; and, in this action, the labels successively separate or peel from the strip, and, a guide on the apparatus successively guides each separated label toward an operably proximal position relative to the first station. The pusher, concurrently driven by the drive means, urges envelopes or similar generally planar articles in the bin toward the proximal position, where the most recently-separated label affixes to the one of said articles in the proximal position.

3 Claims, 3 Drawing Sheets

MANUALLY OPERABLE LABEL-TRANSFER APPARATUS

BACKGROUND OF THE INVENTION

1. Field of the Invention

This invention is in the field of surface bonding and relates to manually operable apparatus for serial transfer of intact adhesive-backed pieces from a flexile backing on which they are carried and onto discrete planar articles. The apparatus initiates transfer of a said piece by applying a bending action the portion of the backing to which one said piece is laminated. For example, the pieces and backing may be a computer-generated set of mailing labels on tractor-feed paper, and the planar articles may be envelopes to which the labels are to be affixed.

2. Description of Related Prior Art.

The prior art related to this invention includes structural elements and operational aspects, as noted, in these U.S. Pat. Nos. 4,648,930, Method Of Separating Labels From A Carrier Strip, discloses automated separation of labels from a sprocket-driven strip moving contiguously as to a planar surface with a V-shaped recess. 4,053,345, Apparatus For Printing And Applying Pressure Sensitive Labels, is representative of label applicators with a hand-held handle and an acutator disposed at the handle whereby small pressure-sensitive labels carried by a strip thereon, such as price tags, are delaminated and transferred to other surfaces. 2,331,019, Label Dispenser, teaches a manual, crank-turned device with label-separating means comprising opposed edges meeting at an angle. 2,276,297, Label Dispenser, is another manual, cranked device and features a sharp label-separating edge. 2,276,296, Label Dispenser, discloses still another manual dispenser which enables a label to be peeled from a strip as the strip is drawn over a smooth guiding edge at a 90° angle from the path defined by the edge.

SUMMARY OF THE INVENTION

Computer-generated sets of mailing labels are a welcome adjunct to the operations of many mailers. The labels of a set usually represent a mailing list. Relative to earlier ways of making labels, addressing envelopes, and maintaining mailing lists, the sets confer advantages such as enhanced reliability and convenience. For small businesses, clubs, church organizations and similar mailers, the sets confer additional advantage in that a vendor, with equipment for generating or printing the sets, may economically maintain and update mailing lists for a number of said mailers, and produce sets of labels for them virtually on demand. Therefore, a mailer who cannot afford or does not want to acquire the equipment, may still enjoy the noted advantages. Indeed, vendors making and supplying the sets have become a flourishing neighborhood-level industry.

Typically, the vendor's equipment generates a set of labels with and on tractor-feedable paper, that is, an elongate flexile backing strip (hereafter, in this summary, "the backing") with holed margins. As supplied to a mailer, the set is a series of spaced labels, each with an adhesive back, laminated at the back to and carried on the backing. Utilization of such a set has heretofore involved at least one person performing a by-hand process of removing each label in succession from the backing, shifting a last-removed label to an envelope remote from labels still on the backing, affixing said label to the piece, and returning for the next label. This process is disadvantageous or objectionable in that it is slow, tedious, and unduly time-consuming, and the person's fingers apt to become increasingly sticky.

In summary, the apparatus of this invention is characterized by a transit path between up-path first and down-path second stations which bends the backing and the labels thereon around a sharp turn as it leaves the first station. The first station has guide member or guide, and an associated delaminating member or delaminator whereof an upper edge defines the turn. The guide is spaced outwardly of the delaminator to leave an opening for the path between them. The backing has a leading end or leader where no label is carried and which is introduced to the apparatus at the first station. The second station has tractor means for engaging the backing, initially by and at the leader.

The apparatus has manual drive means for the tractor means to draw the backing and the labels thereon down-path. As drawn and bent around the turn, the backing describes the smallest radius at the turn, and a label, outward of the backing, progressively separates or delaminates from the backing over the area of the label's adhesive back. In the separation, the label tends first to be tangential of the path immediately up-path from the turn and then approaches radial relationship to, and passes upwardly out of, the turn, exposing the label's adhesive back in a forward orientation. As thus being separated, a label also is readied for transfer and guided by the guide to bond with and on a planar article such as an envelope.

The apparatus has a bin adjoining the first station wherein a number of envelopes or similar articles are received, and a pusher in the bin. The drive means also is adapted to drive the pusher to urge bin-received articles toward and to a proximal position at or adjacent the first station. During and upon separation, the guide, which has an upper edge portion that is curved or inclined toward the bin and overarches the delaminator, contacts the label along the label's un-adhesive front and directs it forwardly and onto the article in the proximal position so that its exposed adhesive back—beginning along its upper edge—touches and affixes to the article.

A first object of this invention, as described in this summary, is to provide apparatus for reducing or obviating the said matters of disadvantage or objection, and generally enhancing and promoting utilization of computer-generated mailing labels and similar backing-borne adhesive pieces. Although the prior art includes various delaminating edges, the guide and the cooperative association of the guide and the delaminator is a notable feature of this invention.

A second object is to enable a dual "as generated" and "as transferred" utilization with reference to the backing as well as the labels thereon. This apparatus implies that the holed margins, which were utilized in making the labels, be used again, with the tractor means and for the label-transfer operation. Accordingly, the tractor means is a notable feature of this invention.

A third object is to afford—consistent with and in aid of the advantages noted for said first and second objects—apparatus that is simple, compact, easily operated and maintained, and inexpensive. In all these objects, the invention pertains particularly to small businesses, clubs, church groups and similar others who, for mailing and similar operations, do not have equipment for generating the labels or for automated affixation thereof to mailing pieces.

DESCRIPTION OF THE PREFERRED EMBODIMENT

Figure 1:
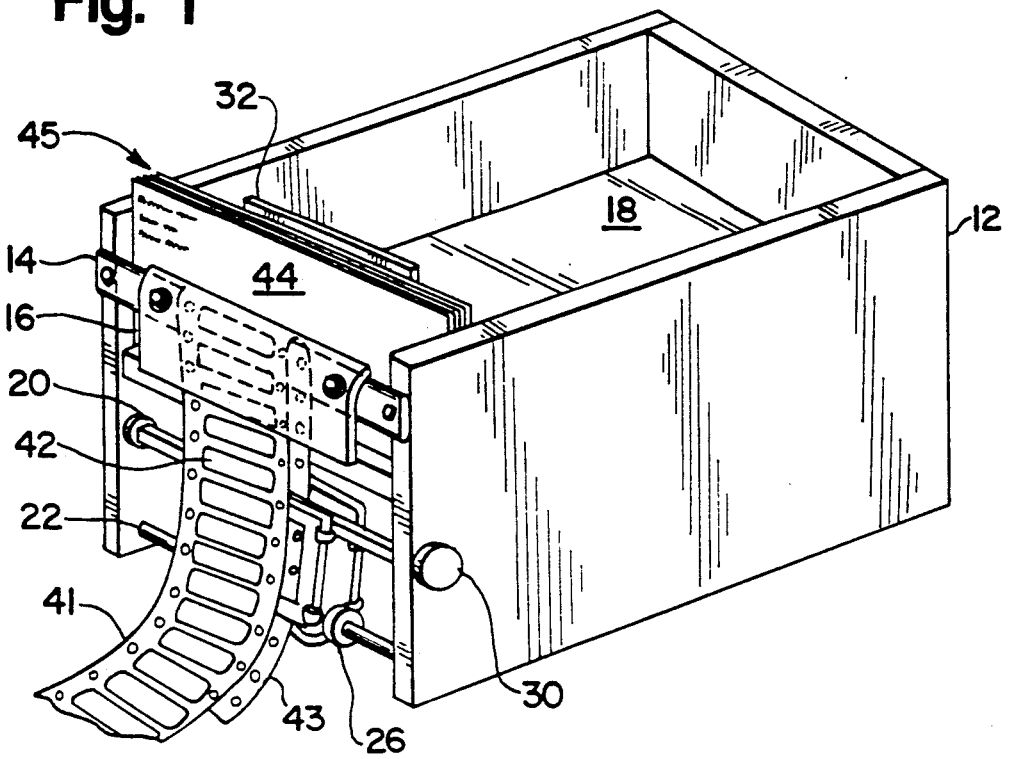
FIG. 1 is a general top-side perspective view of apparatus of this invention; a backing strip (with labels thereon) is inserted in the apparatus via up-path guide and delaminator members, the strip is engaged with the apparatus by down-path tractor units, and to-be-labelled envelopes are in the bin thereof.
Figure 2:
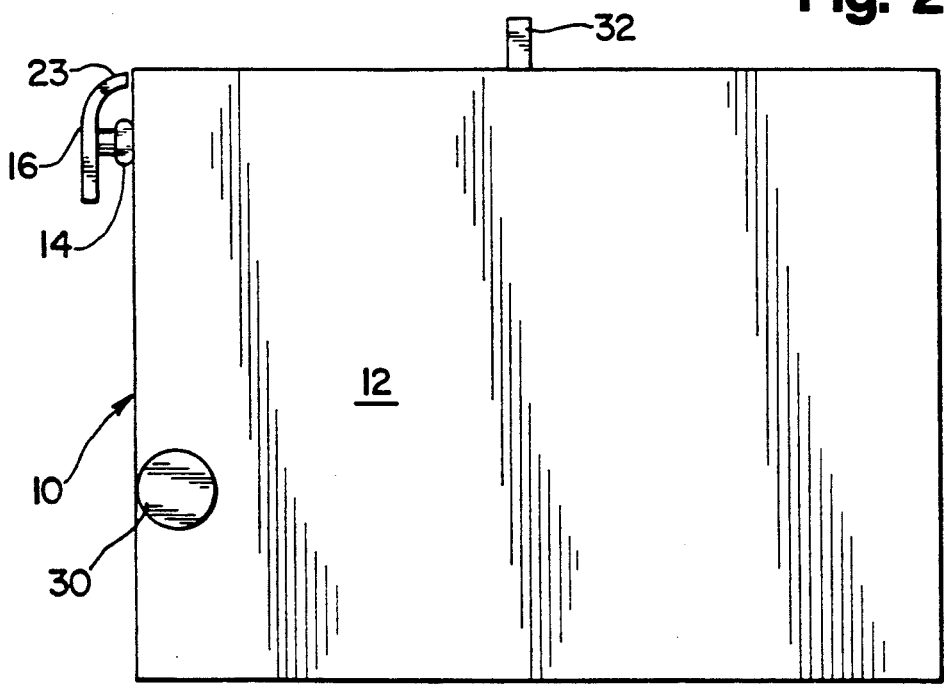
FIG. 2 is a side elevation of the apparatus.

The drawings disclose a preferred embodiment of this invention. In the drawings reference numerals identify elements and aspects of the invention, as follows: 10 is the apparatus; 12 is the base of apparatus 10; 14 is the delaminator, 16 is the guide, 18 is the shelf, 20 is the upper rotatable shaft and 22 is the lower fixed shaft, all on base 12; 23 is the upper, forwardly-inclined or curved edge-portion of guide 16; 24 shows a slot in shelf 18; 26 is each of two tractor units on shafts 20 and 22; 28 is a front pulley-wheel and 30 is a knob, both being on and rotatable with shaft 20; 32 is a pusher; 33 is each of two rollers and 34 is a ventral portion of pusher 32; 36 is a rear pulley-wheel on base 12 and beneath shelf 18; and, 38 is drive belt means operative between wheel 28, wheel 36 and portion 34.

Figure 4:
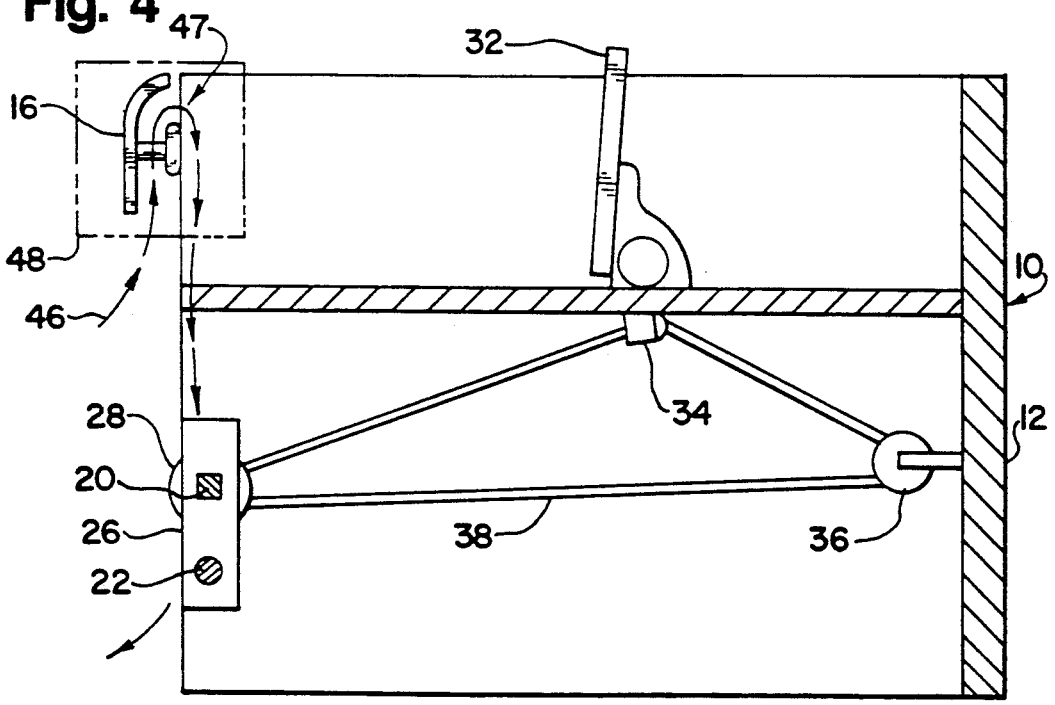
FIG. 4 is a side sectional view of the apparatus corresponding to the elevation of FIG. 2 and at line 4—4 of FIG. 3, and indicating the transit path for the backing strip.
Figure 5:
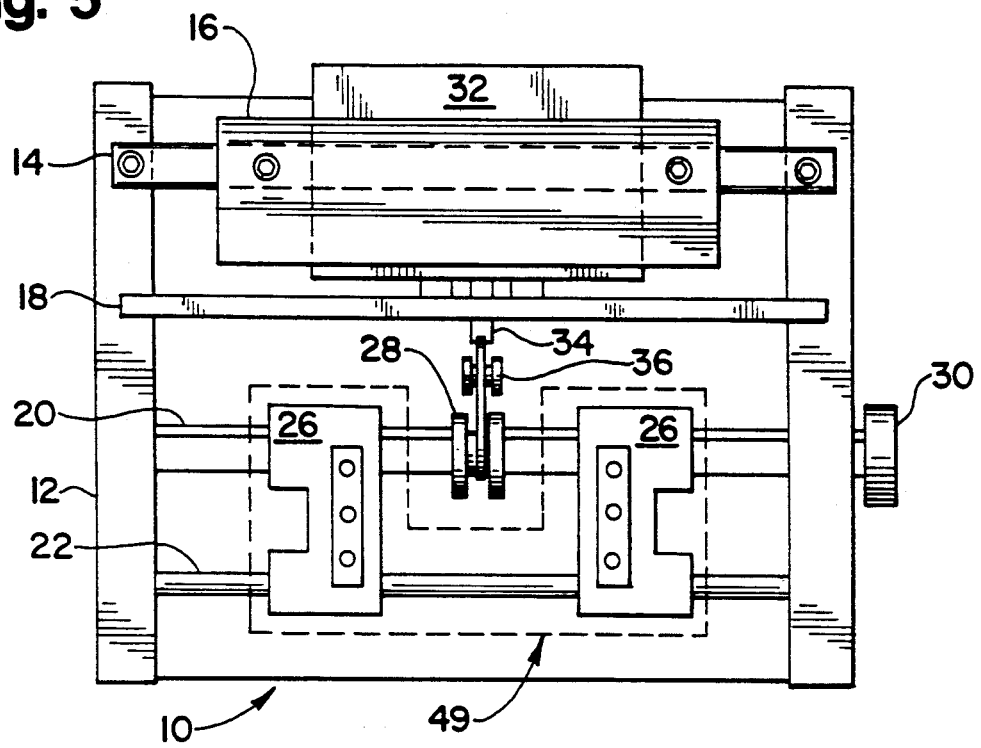
FIG. 5 is a front elevation of the apparatus including front depiction of the two tractor units thereof; the front doors of the tractor units are closed.

Also, these additional reference numerals: In FIG. 1, 41 is a flexile backing strip with holed marginal portions, 42 is each of several adhesive-backed pieces laminated on strip 41, 43 is the leader of strip 41 (on which no piece 42 is carried), 44 is a planar article in operable proximal position relative to delaminator 14 and guide 16, and 45 is each of several other planar articles on shelf 18 and in said bin. In FIG. 4, 46 identifies a dashed-and-arrowed line indicating the transit path for strip 41 relative to apparatus 10, 47 locates the sharp turn in path 46, and 48 is a dashed line showing delaminator 14 and guide 16 as the first or up-path station on path 46. In FIG. 5, 49 is a dashed line showing both tractor units 26 as defining the second or down-path station on path 46.

Units 26 are conventional tractor assemblages of the same type as are familiar on powered equipments, and they engage, and are thus adapted to transport, tractor-feed paper and similar flexile materials. Each unit 26 has a drive sprocket adapted to rotate with and be carried on shaft 20, a driven sprocket adapted to rotate on shaft 22, and a vertically-oriented toothed drive belt between the sprockets and with which the holed margin engages. A unit 26 may have a front door which, even when closed, does not impair the engagement of the strip or the unit's capability to transport the strip. In this description the units 26 are singly or collectively referred to as "tractor means" or "tractors".

Pieces 42 may be address-bearing mailing labels, and articles 44 and 45 may be envelopes or similar mailing pieces. For exemplary purposes in this description, each piece 42 is referred to as a "label", and each article 44 or 45 is referred to as an envelope.

Referring to FIG. 1—and regarding apparatus 10 from top to bottom—base 12 has opposed side walls and a back, a shelf 18, and upper and lower portions above and below the shelf. Above the shelf, the walls and back form a bin with an open side. Delaminator 14—a thin, planar or blade-like, elongate, rigid and preferably transparent member—is conventionally mounted wall-to-wall across the open end as, for example, by screws. Guide 16 is also thin, rigid and preferably transparent, but of lesser transverse dimension and taller than delaminator 14, and is mostly planar but further characterized by edge 23 somewhat above and curving or inclining onwardly, that is, toward the bin and above the top edge of the delaminator. The guide is conventionally attached to and in spaced relationship with the delaminator, as by screws, with washers or similar disc-like spacers between them. In this spaced relationship edge 23 at least half-way overarches the delaminator, and may be substantially co-planar with a plane defined by the delaminator's inward surface or extend inwardly—that is, toward the bin—slightly beyond said plane.

Figure 3:
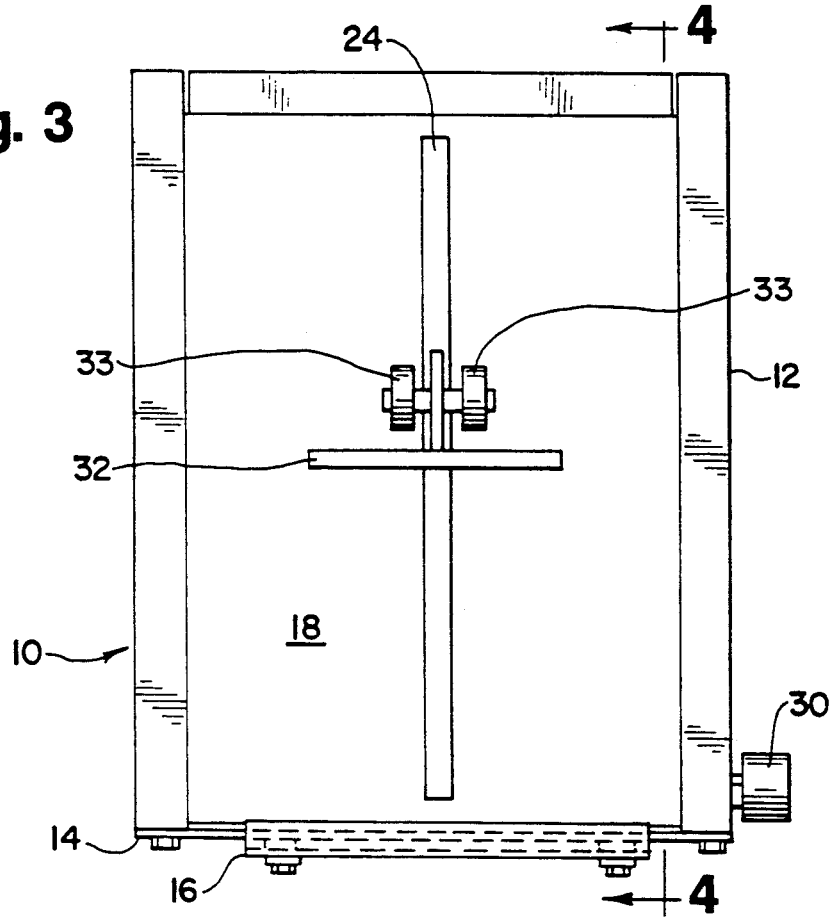
FIG. 3 is a plan view of apparatus.

Next, as FIG. 3 shows, shelf 18 provides slot 24 between or to points respectively close to the back and the open end. The shelf is horizontal and adapted to carry pusher 32, with the pusher's flat and substantially erect forward surface facing toward the open end, and with rollers 33 riding on the shelf and portion 34 depending in the slot and beneath the shelf.

Finally, beneath shelf 18, as FIG. 4 illustrates, shafts 20 and 22 are conventionally mounted transverse of and intermediate the walls, and generally below the open end. The shafts carry the tractors 26 with, as described, their sprockets adapted to rotate and each tractor adapted to be optionally slidably moved along its shafts. Shaft 20 is the drive shaft, it rotates in either direction, and its connection with the drive sprockets—enabling them to rotate with it—may be advantageously arranged, for example, by providing it as a square shaft and matching and fitting it to drive sprockets with square central apertures. Knob 30 is at an end of shaft 20 as crank means thereon and to rotate the shaft and the drive sprockets of the tractor means. Shaft 22 is a fixed member and, again, the tractors' driven or lower sprockets rotate on but not with shaft 22.

Shaft 20 also carries and is rotatably joined with front pulley 28, and belt 38 runs between the front pulley, rear pulley 36 and ventral portion 34 (depending beneath shelf 18), and is attached to portion 34. The belt moves both clockwise and counter-clockwise (see FIG. 4) and may as necessary be conventionally tensioned by a spring or other means. Accordingly, as knob 30 is rotated to crank shaft 20, the rotation imparted to the front pulley drives pusher 32 toward or away from the open end of base 12. Thereby, as in FIG. 1, envelopes in the bin, between the pusher and the open end, may be urged toward edge 23 and station 48.

Strip 41 is introduced to apparatus 10 by passing leader 43 into the path-entry defined by and at the lower portions of delaminator 14 and guide 16, and then along path 46, as FIG. 4 indicates, making sharp turn 47 around the upper edge of the delaminator, and into engagement by the holed margins thereof with tractors 26 at station 49. Typically, the tractors have front doors, which are open to allow the engagements, and thereafter closed until a label-exhausted strip is to be removed from or a fresh strip introduced to apparatus 10. Leader 43 either may be supplied without labels 42, or a first few of the labels may be left intentionally unprinted and stripped off before the strip is introduced.

Figure 6:
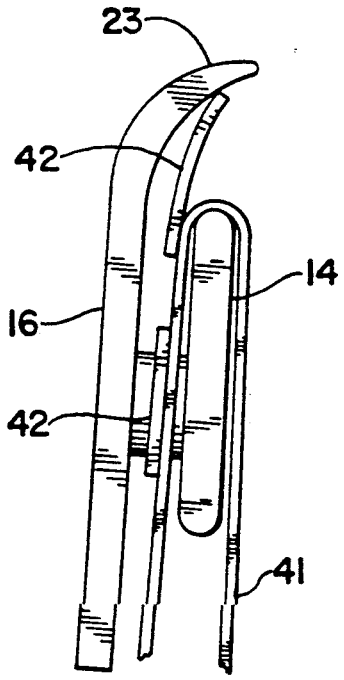
FIG. 6 is a side-view sketch illustrating in larger scale the spaced relationship between the guide and delaminator members, and a label separating from the backing strip.

With strip 41 engaged, knob 30 is hand cranked concurrently to accomplish two actions: (a) to draw and bend successive lengths the strip down-path from station 48, around turn 47 and to station 49, and (b) to urge all envelopes in the bin toward, and the present first envelope 44 thereof to, proximal position with reference to the first station. As to action (a), up-path from the turn, the close spacing between guide 16 and delaminator 14—in addition to providing the path-entry—imparts a nearly or virtually vertical component to the path, to assure that an engaged strip 41 experiences at turn 47 a near reversal or directional change of at least, say, 160° or, even closer to or effectively, 180°. As described under the summary of the invention and sketched in FIG. 6, as a label reaches the delaminator and passes the turn, the bending action serves progressively and upwardly to peel it from the strip, with its now-exposed adhesive back forwardly oriented toward the envelope in the proximal position, and guided by guide 16 and edge 23 to contact and become affixed to that envelope.

As to action (b), the proximal position may be defined or located as the position of envelope 44 when and whereat it touches or contacts edge 23, or is otherwise operably proximate the edge, so that a label 42 passing the guide readily affixes to it. Thereafter, the envelope is hand-removed from the bin, with the next label ready to be advanced down-path, and the next envelope ready to be urged to proximal position.

With further reference to this preferred embodiment and utilization thereof, base 12 may be fabricated of wood or other suitable materials. The bin of base 12 is suitably proportioned; its width or transverse dimension may slightly exceed 9½ inches or some other familiar length of an envelope 45, and shelf 18 defines a bin-depth of about one-half the width of such an envelope or otherwise corresponding to the intended place of affixation of a label 42 on the envelope. The height of edge 23 likewise corresponds with the intended place of affixation.

Delaminator 14 and guide 16 may have respectively, for example, thickness of approximately ⅛-inch, and spacing between them is close, for example, a dimension in the ¼-inch to ½-inch range, but, in any case, sufficient to allow unimpeded down-path movement of strip 41. To accommodate various strip-widths, the delaminator and guide have suitably—generous transverse dimensions across the open end. The delaminator and guide are thus cooperative structural elements, and, as joined and comprising station 48, they effectively form a first-station member, as shown in FIG. 4.

Also, tractors 26, and shafts 20 and 22 as associated with and carrying the tractors, comprise a notable second-station assemblage. The above-noted slidable relationship between the tractors and the shafts in this assemblage enables the tractors—over a range of dimensions, and with reference to each other and said first-station member—to accommodate various strip-widths.

These particulars also pertain to or describe this preferred embodiment. In a working embodiment of apparatus 10, base 12 has height of 9⅞ inches, overall lengthwise dimension of 11½ inches, and bin depth of 4¾ inches, to adapt and size it for desk top use. As an alternative for modest-sized knob 30, larger crank means may be provided. One example of strip 41 is the commercial product which has width of 3½ inches and is identified by Stock No. D-35-15-1 of the firm Data Labels, 1000 Spruce Street, Terre Haute, Ind.; the paper of said product is known as 50 pound line material coated or waxed with silicone.

Various other specific embodiment are within the spirit and scope of this invention.

What is claimed is

1. An apparatus for transferring spaced adhesive-backed pieces from laminated association on a tractor-feedable backing strip and onto planar articles comprising:

a base defining a bin with an open end;

a pusher in the bin and adapted to be urged toward and away from the open end;

first and second stations on the base and defining a transit path between the stations for the backing strip whereof the first station comprises a delaminator defining a sharp turn in the path, and a guide member carried on and spaced outwardly from the delaminator to leave a space for the path between the delaminator and the guide member, and the second station has tractor means adapted to engage with the backing strip, manually operable drive means associated with the pusher and the tractor means, so that, after the backing strip is located along the path and in engagement with the tractor means, and at least one article is in the bin intermediate the pusher and the first station, the drive means may be operated concurrently to urge the pusher toward the open end and bring said article to proximal position relative to the first station, and to advance the backing strip and a piece laminated thereto through the delaminator and the guide member whereby, in the action of advancing and drawing the backing strip around the turn, said piece delaminates from the backing strip and is guided to transfer onto said article at the proximal position.

2. The apparatus of claim 1 where said adhesive-backed pieces are labels; said planar articles are envelopes; the base includes a shelf, and carries a rotatable first shaft and a fixed second shaft; the delaminator is an elongate member; the guide includes an upper edge-portion arching toward the bin; the shelf defines a slot; the pusher is adapted to move on the shelf and has a ventral portion adapted to depend, via the slot and when the pusher is on the shelf, beneath the shelf; the tractor means are carried on the shafts; and, the drive means include a crank on the first shaft, and a belt attached to the ventral portion and operative between the base, the first shaft and the ventral portion.

3. The apparatus of claim 2 where the delaminator comprises a planar member and the sharp turn, as defined by the apparatus, defines for the strip being drawn down-path around the turn, a directional change of between 160° and 180°.

* * * * *